US008228153B2

(12) United States Patent
Ceretta

(10) Patent No.: US 8,228,153 B2
(45) Date of Patent: Jul. 24, 2012

(54) POWER REACTOR FOR ENERGY TRANSFER

(75) Inventor: Claudio Ceretta, Montegrotto Terme (IT)

(73) Assignee: Societa' Elettromeccanica Arzignanese, S.p.A., Montegrotto Terme (IT)

( * ) Notice: Subject to any disclaimer, the term of this patent is extended or adjusted under 35 U.S.C. 154(b) by 59 days.

(21) Appl. No.: 12/309,011

(22) PCT Filed: Jun. 26, 2007

(86) PCT No.: PCT/IB2007/001905

§ 371 (c)(1),
(2), (4) Date: Jul. 31, 2009

(87) PCT Pub. No.: WO2008/004107

PCT Pub. Date: Jan. 10, 2008

(65) Prior Publication Data

US 2010/0013586 A1 Jan. 21, 2010

(30) Foreign Application Priority Data

Jul. 3, 2006 (IT) ..... VI2006A0203

(51) Int. Cl.
*H01F 27/02* (2006.01)

(52) U.S. Cl. ..... 336/90; 336/92

(58) Field of Classification Search ..... 336/90, 336/92, 205, 206, 207
See application file for complete search history.

(56) References Cited

U.S. PATENT DOCUMENTS

| | | | | | |
|---|---|---|---|---|---|
| 2,366,290 | A | * | 1/1945 | Rudd | 336/58 |
| 2,748,356 | A | * | 5/1956 | Kaehni | 336/58 |
| 3,014,189 | A | * | 12/1961 | MacKinnon et al. | 336/87 |
| 3,164,793 | A | * | 1/1965 | Aronson | 336/65 |
| 3,234,493 | A | * | 2/1966 | Zwelling et al. | 336/94 |
| 3,292,048 | A | * | 12/1966 | Swoish et al. | 361/41 |
| 3,340,489 | A | * | 9/1967 | Bastis et al. | 336/61 |

(Continued)

FOREIGN PATENT DOCUMENTS

EP 0 536 010 A 4/1993

(Continued)

OTHER PUBLICATIONS

PCT Search Report dated Dec. 12, 2007.

*Primary Examiner* — Anh Mai
*Assistant Examiner* — Joselito Baisa
(74) *Attorney, Agent, or Firm* — Hedman & Costigan, P.C.; James V. Costigan

(57) ABSTRACT

A power reactor (1) for energy transfer comprising a shaped casing (2), which sits upon a support structure, and a winding (3) which is electrically connected to an electrical energy supply network and is contained inside the shaped casing (2) with which it is associated through support means (4). The shaped casing (2) and the winding (3) are arranged a first distance (D) apart which is a function of the electrical current, of the inductance and/or of the geometry of the winding and is not less than a predetermined minimum value in order to make it possible to absorb the energy losses created by the parasite currents generated by the magnetic flux produced by the winding (3) and that engages the shaped casing (2), the first distance (D) diverging towards the shaped casing (2) from the end portions (3*a*, 3*b*) of the winding (3) crossed by the flux lines of the magnetic field that link together with the winding (3).

7 Claims, 2 Drawing Sheets

U.S. PATENT DOCUMENTS

| | | | | | |
|---|---|---|---|---|---|
| 3,362,000 | A | * | 1/1968 | Sealey et al. | 336/58 |
| 3,405,283 | A | * | 10/1968 | Leonard | 307/95 |
| 3,462,645 | A | * | 8/1969 | Leonard | 361/38 |
| 3,504,319 | A | * | 3/1970 | Leonard | 336/68 |
| 3,534,311 | A | * | 10/1970 | Bell | 336/84 R |
| 3,602,631 | A | * | 8/1971 | Sheppard | 174/17 R |
| 3,629,758 | A | * | 12/1971 | Pearce, Jr. | 336/57 |
| 4,030,058 | A | * | 6/1977 | Riffe et al. | 336/92 |
| 4,390,858 | A | * | 6/1983 | Schulzer | 336/92 |
| 4,437,082 | A | * | 3/1984 | Walsh et al. | 336/58 |
| 6,750,749 | B2 | * | 6/2004 | Shirahata et al. | 336/55 |
| 6,838,968 | B2 | * | 1/2005 | Nick et al. | 336/57 |
| 7,843,298 | B2 | * | 11/2010 | Hosokawa et al. | 336/90 |

FOREIGN PATENT DOCUMENTS

| | | | |
|---|---|---|---|
| EP | 1 426 984 | A | 6/2004 |
| GB | 294 938 | A | 1/1929 |
| JP | 2003 289008 | A | 10/2003 |

* cited by examiner

POWER REACTOR FOR ENERGY TRANSFER

The present invention concerns a power reactor for energy transfer, in particular a power reactor of the type immersed in insulating oil.

As is well known, in the field of electrotechnology reactors are apparatuses intended to transfer energy offering a certain reactance to the passage of an electrical current.

For this purpose we recall that reactance is the coefficient of the imaginary part of impedance, a physical magnitude that under alternating or sinusoidal current expresses the ratio between the voltage and the current, therefore being analogous to the resistance under direct current.

In the current state of the art, the power reactors introduced above are available on the market in numerous constructive solutions but they essentially come down to two main categories, one represented by reactors insulated in air and the other by reactors insulated in oil.

Reactors insulated in air, particularly suitable for cases of low inductance, comprise one or more coils exposed to free air or contained in an encasing element, made from resin.

Reactors insulated in air have the advantage of being "linear" with the voltage and the electrical current, but the disadvantage, precisely due to the fact that the cooling fluid is air, of requiring conductor elements with large section in order to manage to drain the energy losses produced inside them.

Reactors insulated in oil or in another dielectric fluid, on the other hand, include a shaped casing, generally parallelepiped and made from metallic material such as magnetic steel, inside of which a coil is arranged immersed in the oil and associated with the casing through support means of various type.

In particular, the support means are applied to a covering element that closes the casing on top and in which, amongst other things, the power supply terminals are usually defined.

This embodiment, like that of power transformers, allows a greater cooling capacity and, consequently, allows smaller sections of the conductor elements assigned to the drainage of the energy losses compared to reactors insulated in air.

Known reactors can also be classified, according to the magnetic circuit in which the flux develops, into reactors in air and reactors in iron.

In iron reactors, for which some embodiments foresee insulation in air and others insulation in oil, the flux mainly develops in a magnetic circuit with air gaps and the magnetic energy is practically totally contained in the gaps.

The advantage of reactors with magnetic circuit with gaps consists of the very low sizes and the almost absolute lack of fluxes dispersed.

Recently, moreover, in order to satisfy certain application requirements, power reactors with so-called "fixed" or "mobile" winding or coil have been released onto the market.

In brief, a power reactor with fixed coil has a reactance of constant value for every socket but variable from socket to socket.

A power reactor with mobile coil, on the other hand, has a continuously variable reactance in the same socket, thanks to a modification of the geometric configuration or of the type of the magnetic circuit.

The invention described here deals with reactors insulated in oil and equipped with a fixed coil.

Due to the high electric currents and the magnetic fluxes involved, such reactors have always been built with a magnetic shielding core arranged between the metallic casing and the coil.

The objective of such a constructive provision is to allow the reactor to operate in a controlled magnetic situation, preventing losses and overheating due to parasite currents that could lead to breakdown or damage to the casing.

Moreover, the presence of the shielding core makes it possible to theorise at the design stage conditions for controlling additional losses, not directly resulting from the resistance of the coil, as well as the magnetic flux configuration, favouring a precise calculation of the inductance of the coil itself.

In certain cases, the shielding core consists of a plurality of magnetic sheets—laminations—that channel the magnetic flux avoiding it reaching the shaped casing, whereas in other cases the shielding core consists of copper or aluminium cylinders that, by the effect of the currents induced, block the passage of the magnetic flux.

Power reactors provided with a shielding core, also known as reactors "with window", have over time supplanted reactors with a circuit with an air gap, which have proven not to be very cost-effective.

Nevertheless, such known power reactors, with window, are not without drawbacks of their own.

A first drawback derives from the fact that the shielding core, generally consisting of laminations, has non-linear behaviour, variable point by point, with regard to the induction that it encounters due to the magnetic flux.

Indeed, following increases in magnetic induction, the lamination is unable to maintain characteristics of linearity since the saturation level can easily be reached in some of its particular points.

Therefore, in situations in which the magnetic induction flux encountered by the core increases by a substantially large amount, like for example in the case of failure of the reactor, the lamination loses the shielding properties at certain points thereof.

This causes a loss of reactance or of current limitation capacity by the lamination and, therefore, a reduction in the efficiency of the reactor.

A second drawback is due to the additional losses generated by the metallic material of the shielding core.

Another drawback is linked to the fact that, as is often said, the reactor is equipped with "operation memory": sometimes, indeed, due to the inductance of the coil there is a residual magnetisation, which is always harmful and undesired, deriving from the previous operative conditions and direct consequence of the presence of a shielding core.

A further drawback is represented by the fact that the presence of the shielding core determines a considerable increase in weight of the reactor.

The last but not least drawback of known power reactors immersed in oil and with a fixed coil consists of the substantial cost, a consequence above all of their complexity of manufacture and the cost of the shielding core.

One just has to think that, in the case of the aforementioned lamination, made from steel alloyed with silicon, the cost of the shielding core represents a substantial share of the overall cost, quantifiable as about one third of the overall cost of the reactor.

The present invention intends to overcome the drawbacks of the prior art just quoted.

In particular, the main purpose of the invention is to provide a power reactor for energy transfer that has a higher degree of efficiency than equivalent known reactors, even after critical operating situations.

In such a purpose, a task of the invention is to reduce the reactance losses encountered in a power reactor compared to the prior art.

Another task of the invention is, therefore, to limit the additional losses that occur inside the reactor compared to the prior art.

The task of the invention is also to reduce the residual magnetisation value of the winding of the reactor compared to the current state of the art, to a greater extent freeing each of the operating conditions from the previous operating history.

In other words, therefore, it is wished to offer a power reactor that eliminates or substantially reduces the drawbacks of the prior art caused by the installation of the magnetic shielding core.

Another purpose of the invention is to make a power reactor that weighs less than similar known reactors.

The last but not least purpose of the present invention is to provide a power reactor that has lower production and commercialisation costs than the prior art.

Said purposes are accomplished by a power reactor for energy transfer according to the attached claim 1, to which we refer for the sake of brevity.

Other detailed characteristics of the power reactor according to the invention are outlined in the subsequent dependent claims.

Advantageously, the power reactor according to the invention has no shielding core, present in similar known reactors, compared to which it is therefore substantially lighter, keeping the other factors involved the same.

Such an aspect clearly results in moving and installing conditions easier than the present ones.

The power reactor of the invention has a less articulated and complicated construction than the prior art and involves the elimination of a particularly significant item of expenditure, especially in the case in which the shielding core is lamination.

Overall, these factors reflect in lower production and sales costs in relation to the prior art.

What has just been stated is obtained without being at the expense of the capacity of the power reactor of the invention to keep the physical state of the shaped casing unaltered, avoiding its overheating.

This is despite the fact that in the invention, due to the lack of the shielding core, the shaped casing directly faces the winding that generates the magnetic induction flux.

Again advantageously, the power reactor according to the invention achieves a higher level of efficiency compared to equivalent known reactors.

Indeed, the elimination in the reactor of the invention of the shielding core determines a substantial reduction, if not the total disappearance, of the drawbacks introduced earlier and directly caused by the core itself.

Equally advantageously, the invention reduces the risks of breakdown of a power reactor compared to the state of the art.

Further aspects and features of the invention shall become clearer from the following description, relative to preferred embodiments, given for indicating but not limiting purposes in relation to the attached tables of drawings where:

Figure 1:
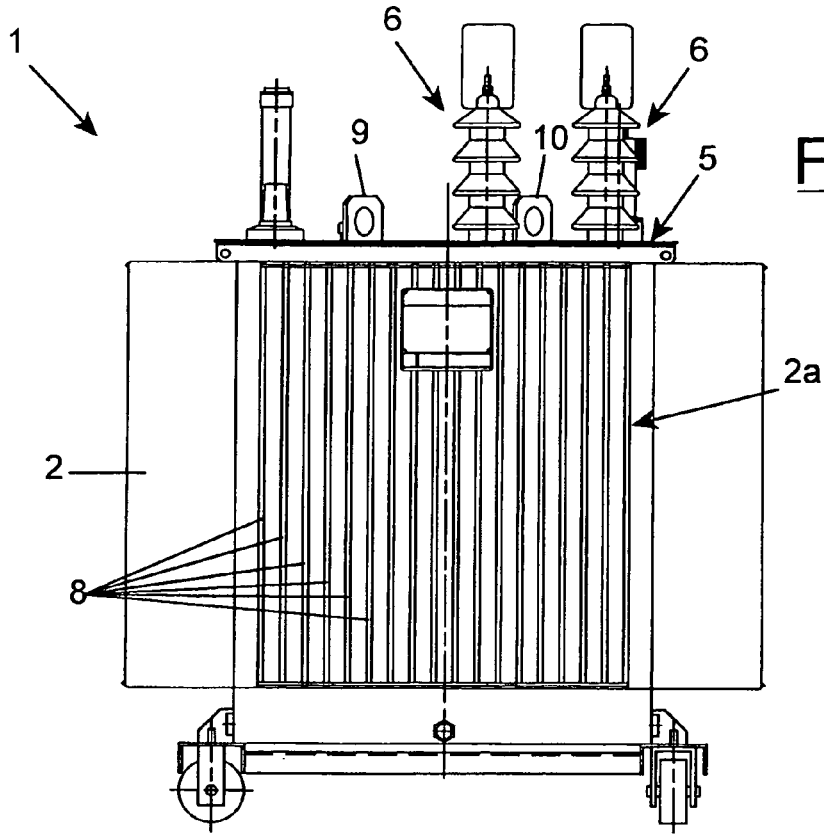
FIG. 1 is a side view of the power reactor according to the invention.

The power reactor for transferring and distributing energy, inserted for example and preferably in series in an electrical energy supply line, is represented in FIG. 1 where it is globally indicated with 1.

Figure 3:
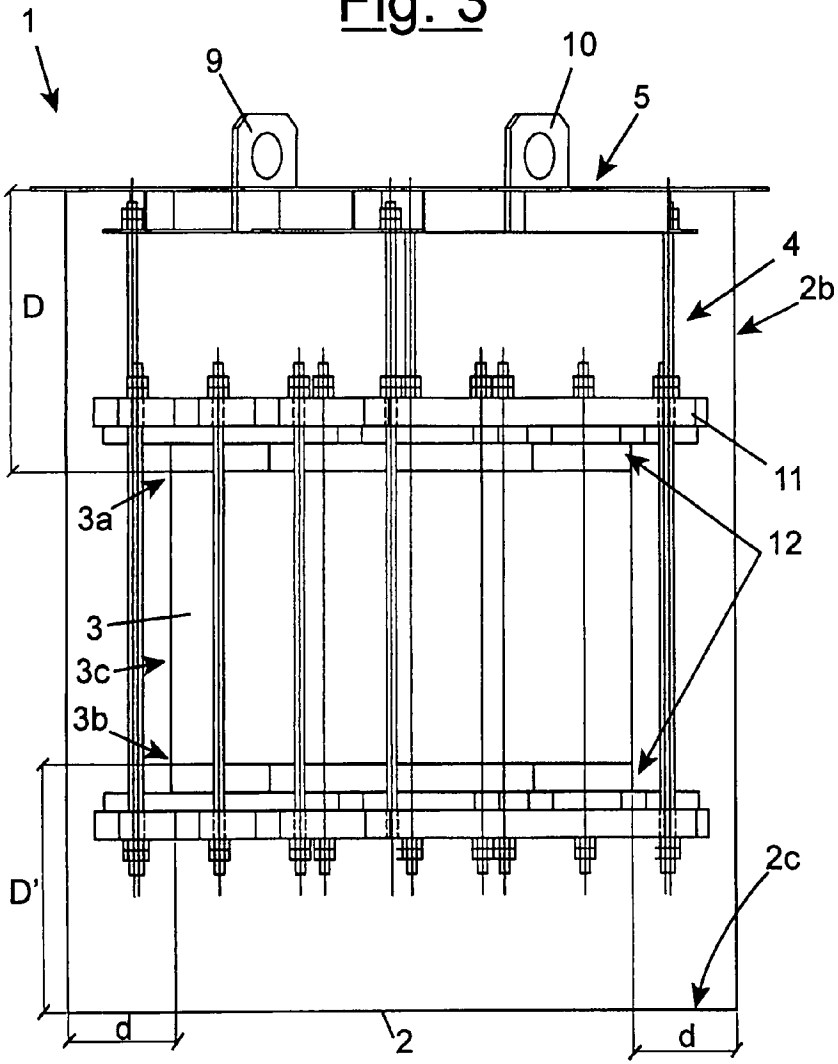
FIG. 3 is a simplified view of FIG. 1 according to a longitudinal section plane.

As can be seen, the power reactor 1 comprises a shaped casing 2 which sits upon a support structure, and a winding 3, visible from FIG. 3, suitable for being electrically connected to an electrical energy supply network and contained inside the shaped casing 2 with which it is associated through support means, wholly numbered with 4 and of the type per sé known to the man skilled in the art.

More precisely but not exclusively, the power reactor 1 is of the type with a fixed winding 3.

In accordance with the invention, the shaped casing 2 and the winding 3 are arranged a first distance D apart, indicated in FIG. 3, not less than a predetermined minimum value in order to make it possible to drain the energy losses created by the parasite currents generated by the magnetic flux produced by the winding 3 and engaging the shaped casing 2.

Again according to the invention, the first distance D diverges towards the shaped casing 2 from one of the end portions 3*a*, 3*b* of the winding 3 crossed by the flux lines of the magnetic field that link up with the winding 3.

In the case under examination, the aforementioned distance D is calculated between a cover 5, coupled at the top and in a stable manner with the shaped casing 2, and the end portion 3*a* of the winding 3.

When the reactor is installed and ready for use, such an end portion 3*a* is normally arranged in the upper area 2*b* of the shaped casing 2.

Figure 2:
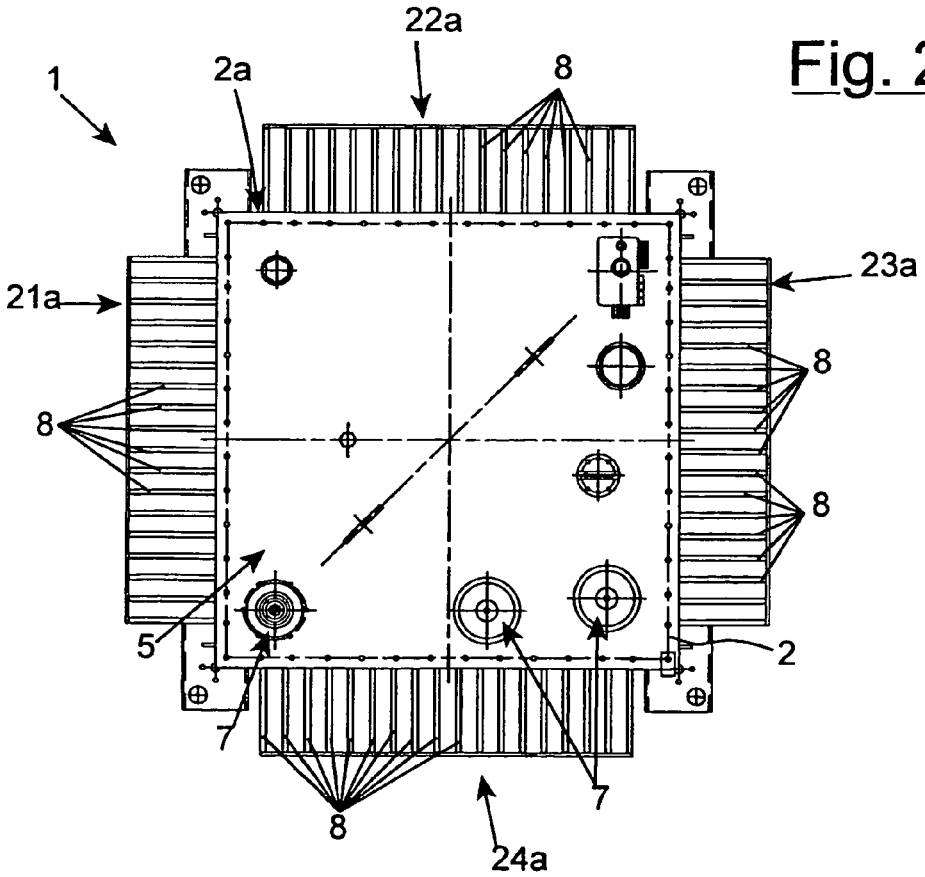
FIG. 2 is the plan view of FIG. 1.

According to constructive schemes known to the man skilled in the art, the cover 5 is provided, amongst other things, with insulating elements 6 and with power supply terminals 7, shown in FIG. 2, for connection to the electrical energy network.

Moreover, as highlighted by FIGS. 1 and 3, the cover 5 is equipped with hooking elements 9, 10 used to lift the reactor 1.

The shaped casing 2 preferably takes up the shape of a parallelepiped with square base for which reason its side wall 2*a* is defined in plan by four portions 21*a*, 22*a*, 23*a*, 24*a* that are the same as one another.

Preferably but not necessarily, each of the portions 21*a*, 22*a*, 23*a*, 24*a* of the side wall 2*a* of the shaped casing 2 is provided on the outside with longitudinal ribs 8 suitable for promoting thermal draining.

It should be understood that, in other constructive solutions of the invention, there can be a smaller number of portions of the side wall of the shaped casing provided with longitudinal ribs.

There can also be further embodiments of the invention, not depicted, in which the shaped casing is shaped differently to what has just been outlined.

Also in this case, the longitudinal ribs can run along the entire side wall or else one or more portions thereof.

Preferably, but not exclusively, the winding 3 is immersed in insulating oil, not illustrated, contained inside the shaped casing 2.

Figure 4:
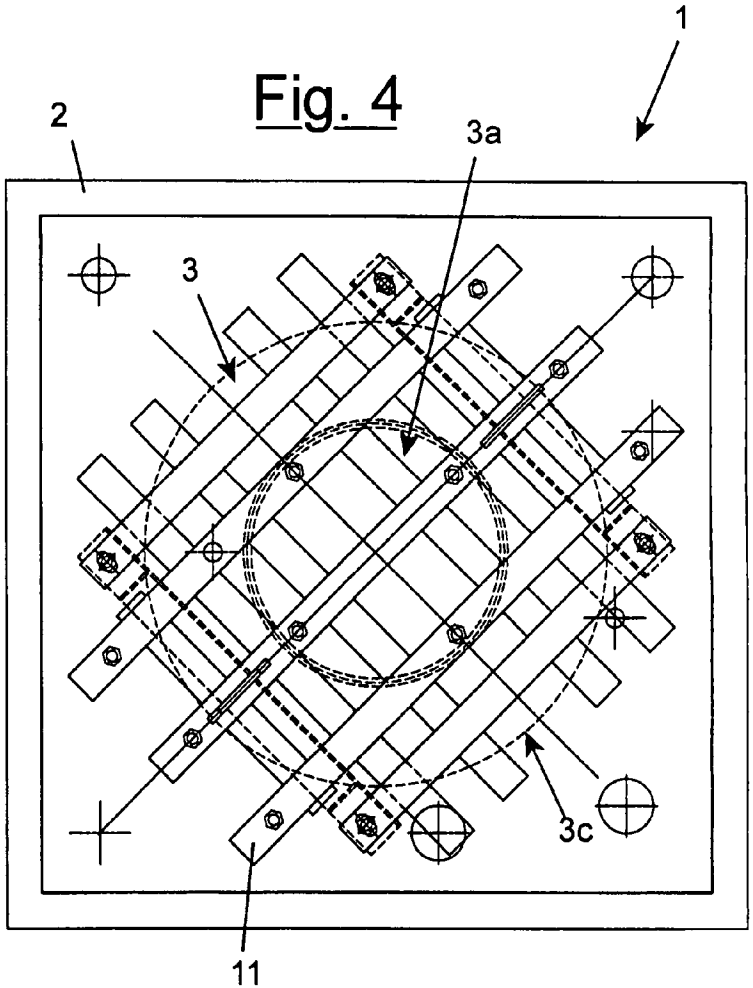
FIG. 4 is the plan view of a detail of FIG. 3.

FIGS. 3 and 4 show that, according to a well-established construction in the field of power reactors, the winding 3 is associated with an armature 11, generally but not necessarily made from wood, and at the end portions 3*a*, 3*b* it is provided with insulating means, wholly indicated with 12.

As discovered from a series of experimental tests carried out by the applicant of the present invention, the predetermined minimum value of the first distance D, beyond which the energy losses created by the magnetic flux produced by the winding 3 and influencing the shaped casing 2 collapse, depends upon some factors such as:

- the inductance of the winding 3;
- the electrical current that crosses the winding 3;
- the ratio between the height and the diameter, therefore the geometry, of the winding 3;

Other parameters that need to be carefully considered in determining the minimum value of the first distance are:

- the metallic material used for the shaped casing 2;
- the thickness of the shaped casing 2;
- the reactance of the winding 3;
- the configuration of the magnetic field produced by the winding 3;
- the resistance of the shaped casing 2 calculated at the magnetic field flux tube that engages the casing 2 itself.

After various tests and quite complicated calculations, the applicant of the present invention came to the conclusion that the predetermined minimum value of the first distance D is substantially equal to 50 mm.

For example, tests carried out on power reactors having a large winding 3 show that the energy losses, created by the parasite currents generated by the magnetic flux produced by the winding 3 and that engage the shaped casing 2, are easily drained by the air that licks the latter right from a value of the first distance D equal to 200 mm.

Specifically, the energy losses decrease according to a substantially exponential law as the predetermined minimum value of the first distance D increases.

The energy losses assume a value of about 600 $W/m^2$ when the first distance is 200 mm.

For example, it has proven that for a value of 350 mm of the first distance D, the energy losses are practically negligible, irrespective of the material used for the shaped casing 2.

Therefore, the power reactor 1 of the invention achieves effective operating conditions without the need to arrange a magnetic shielding core between the shaped casing 2 and the winding 3, as does, however, occur in the prior art.

Indeed, the first distance D between the shaped casing 2 and the winding 3 is such as to prevent the parasite currents generated by the magnetic flux from overheating the shaped casing 2 or even making it unusable.

This covers the basic concept of the present invention, which achieves results that are not only satisfactory but also substantial and ameliorative compared to the prior art, following a path of technical development always discarded from the outset by the designers of the field, due to its danger for the efficiency of the reactor.

Indeed, in the field of technology that it concerns, the elimination of the shielding core between shaped casing and winding has up to now been considered a very risky and unadvisable choice because it is unsuitable for blocking the negative effects produced by the interference of the magnetic field flux with the shaped casing.

FIG. 3 illustrates that the base 2*c* of the shaped casing 2 and the end portion 3*b* of the winding 3 are also separated apart by a first distance D' that, in the example dealt with and purely for indicating purposes, is different from the first distance D between the cover 5 and the end portion 3*a* of the winding 3.

Moreover, the shaped casing 2 and the winding 3 are arranged a second distance d apart, perpendicular to the first distance D and calculated from the side surface 3*c* of the winding 3 towards the side wall 2*a* of the shaped casing 2.

Similarly to the first distance D, the predetermined minimum value of the second distance d is a function of the electrical current, of the inductance and/or of the geometry of the winding 3.

It should be noted that the winding 3 is centred inside the shaped casing 2 for which reason the second distance d between the side surface 3*c* of the first and the side wall 2*a* of the second is the same along the entire circumference defined by the winding 3.

The second distance d has a predetermined minimum value to allow the drainage capacity of the energy losses quoted previously to be increased.

The predetermined minimum value of the second distance d is not greater than the predetermined minimum value of the first distance D, more precisely less since the magnetic flux conditions in the two directions are, as known, different to each other.

In particular, the predetermined minimum value of the second distance d is reduced to ⅕ of the minimum value of the first distance D.

As regards the shaped casing 2, it is made from metallic material, in accordance with known embodiments.

However, according to the preferred embodiment of the invention described here, the metallic material is non-magnetic, having a relative magnetic permeability $\mu_r$ of less than about 1.3 H/m (Henry/meter).

Moreover, the metallic material has a resistivity ρ of no less than about 40 μΩxm (microohmxmeter).

An example of a metallic material having the aforementioned technical characteristics consists of stainless steel.

The arrangement of a shaped casing 2 made from non-magnetic metallic material makes it possible to accentuate the positive effects introduced with the provision of a first distance D of suitable value between the casing 2 itself and the winding 3.

In the shaped casing 2 made from non-magnetic metallic material, the thickness of penetration of the magnetic flux, with the first distance D fixed, is a few centimeters at industrial operating frequencies.

Moreover, as the frequency increases such a thickness of penetration reduces.

This is unlike conventional known casings, made from metallic material having extremely high relative magnetic permeability.

The operation of the power reactor 1 takes place following the classic schemes foreseen by reactors of the prior art, since the modification introduced with the invention concern constructive aspects that do not change the general ways of operating.

Such modifications, however, allow the power reactor according to the invention to achieve important objectives that, in relation to the actual problems of the state of the art, are:

- reduction of weight;
- limitation of complexity of construction thanks to the elimination of components that were previously essential;
- lowering of the design, production and material procurement costs;
- linearity of the material of the shaped casing for any voltage value applied;
- increased operating efficiency thanks to the elimination of the shielding core, an aspect that involves:
  - reduction of the reactance losses;
  - reduction of the additional losses due to induced currents;
  - substantial limitation of the residual magnetisation that makes every working point of the reactor according to the invention practically independent from the previous operation.

In virtue of what has been outlined above, it should therefore be understood that the power reactor for energy transfer according to the invention accomplishes the purposes and achieves the advantages mentioned previously.

In the embodiment step, modifications can be made to the power reactor of the invention consisting, for example, of a composition of the support means of the winding that is different from the one illustrated in the following drawings.

In addition to this, other embodiments of the power reactor of the invention can have the distance between the base of the shaped casing and the lower end portion of the winding equal to the first distance between the upper part of the casing or the cover and the upper end portion of the winding.

It is clear that numerous other variants can be brought to the power reactor in question, without for this reason departing from the novelty principles inherent to the inventive idea expressed here, just as it is clear that, in the practical embodiment of the invention, the materials, the shapes and the sizes of the illustrated details can be whatever, according to requirements, and replaced with others that are technically equivalent.

The invention claimed is:

1. Power reactor (1) for energy transfer comprising:

a shaped casing (2) which sits upon a support structure; a winding (3), suitable for being electrically connected to an electrical energy supply network, contained inside said shaped casing (2) with which it is associated through support means (4), characterised in that said shaped casing (2) and said winding (3) are arranged a first distance (D) apart which is a function of the electrical current, of the inductance and/or of the geometry of said winding (3) and is not less than a predetermined minimum value in order to make it possible to drain the energy losses created by the parasite currents generated by the magnetic flux produced by said winding (3) and that engages said shaped casing (2), said first distance (D) diverging towards said shaped casing (2) from at least one end portion (3*a*, 3*b*) of said winding (3) crossed by the flux lines of the magnetic field that link together with said winding (3) wherein said shaped casing is made from a nonmagnetic metallic material and wherein said winding (3) is immersed in insulating oil contained inside said shaped casing (2) wherein said shaped casing (2) and said winding (3) are arranged a second distance (d) apart where said second distance (d) is perpendicular to said first distance (D) and said second distance (d) is calculated from the side surface (3*c*) of said winding (3) towards said shaped casing (2) which has a predetermined minimum value to increase the drainage of said energy losses, said predetermined minimum value of said second distance (d) being a function of the electrical current, of the inductance and/or of the geometry of said winding (3); said predetermined minimum value of said second distance (d) being no greater than said predetermined minimum value of said first distance (D) and said predetermined minimum value of said second distance (d) is reduced to ⅕ of said minimum value of said first distance (D).

2. Reactor (1) according to claim 1) characterised in that said predetermined minimum value of said first distance is substantially equal to 50 mm.

3. Reactor (1) according to claim 1 characterised in that said energy losses decrease according to a substantially exponential law as said predetermined minimum value of said first distance (D) increases.

4. Reactor (1) according to claim 1 characterised in that said metallic material has a relative magnetic permeability ($\mu_r$) of less than about 1.3 H/m.

5. Reactor (1) according to claim 1 characterised in that said metallic material has a resistivity (p) of not less than about 40 μΩxm.

6. Reactor (1) according to claim 1 characterised in that said metallic material consists of stainless steel.

7. Reactor (1) according to claim 1 characterised in that one or more portions (21*a*, 22*a*, 23*a*, 24*a*) of the side wall (2*a*) of said shaped casing (2) are provided on the outside with longitudinal ribs (8) suitable for promoting thermal draining.

* * * * *